US005577945A

United States Patent [19]

LaBelle

[11] Patent Number: 5,577,945

[45] Date of Patent: Nov. 26, 1996

[54] CHILD-TRANSPORTABLE PORTABLE TOY-ASSEMBLY SET

[76] Inventor: Michael LaBelle, 10 Longview Ave., Madison, N.J. 07940

[21] Appl. No.: 326,392

[22] Filed: Oct. 20, 1994

Related U.S. Application Data

[63] Continuation-in-part of Ser. No. 19,891, Feb. 19, 1993, abandoned.

[51] Int. Cl.[6] ..... A63H 33/04; A63H 29/10; A63H 3/52

[52] U.S. Cl. ..... 446/75; 446/89; 446/166; 446/267

[58] Field of Search ..... 446/70, 75, 74, 446/73, 71, 76, 85, 89, 166, 167, 168, 179, 176, 267

[56] References Cited

U.S. PATENT DOCUMENTS

| | | | |
|---|---|---|---|
| 1,175,225 | 3/1916 | Bleecker | 446/70 X |
| 1,511,211 | 10/1924 | Baublitz | 446/166 |
| 4,170,839 | 10/1979 | O'Donnell | 446/89 |
| 4,637,805 | 1/1987 | Sweetin | 446/71 |

FOREIGN PATENT DOCUMENTS

| | | | |
|---|---|---|---|
| 2048088 | 12/1980 | United Kingdom | 446/89 |

*Primary Examiner*—Robert A. Hafer
*Assistant Examiner*—D. Neal Muir
*Attorney, Agent, or Firm*—William T. Hough, Esq.

[57] ABSTRACT

A portable toy-assembly set that in a disassembled state is of a sufficiently miniature size as to be transportable by a child and assembled by a child, as water tank-like vessel having a sufficiently large upper water addition opening as to enable a child to add water thereto, drainable therefrom by a lower positioned drainage port connectable by disassembled joinable transparent conduits, with water-head pressure providable by disassemble support structure joinable with the tank-like vessel to support the tank-like vessel at selectable elevation. The conduits are connectable to a water-drivable accessory. A handle is mounted on the tank-like vessel or a vessel lid secureable to the tank-like vessel, enabling a child to more easily transport the portable toy-assembly set.

7 Claims, 2 Drawing Sheets

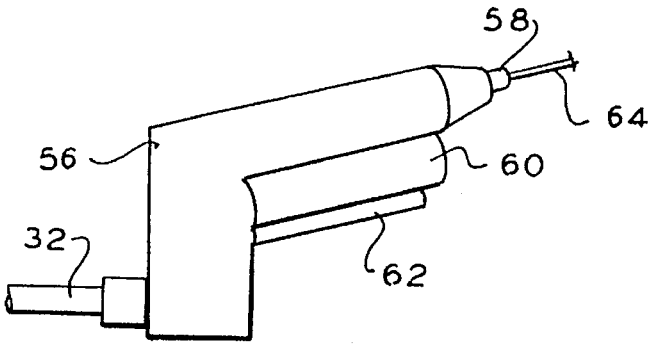
FIG. 6
FIG. 7
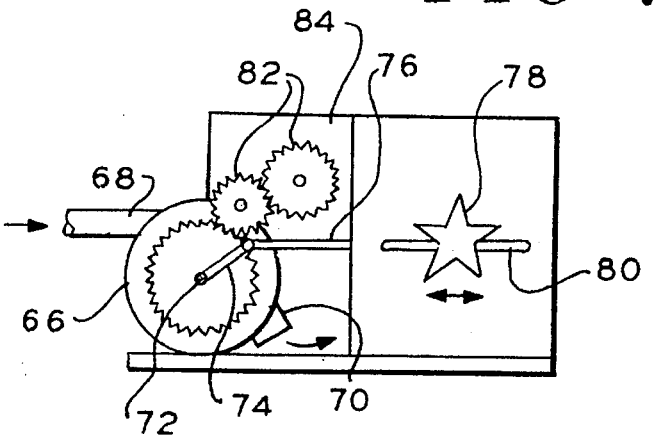
FIG. 8
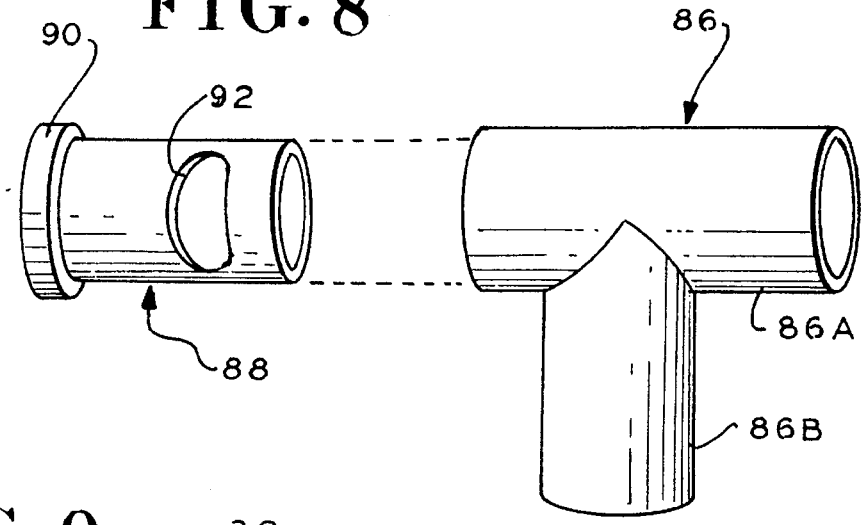
FIG. 9
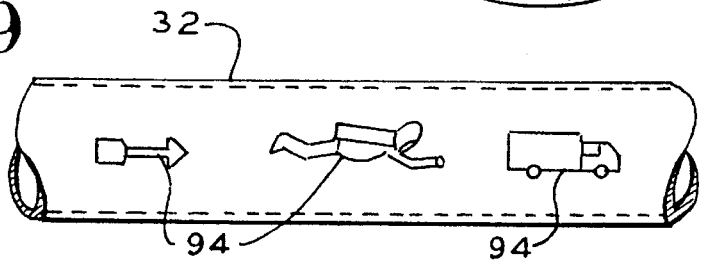

CHILD-TRANSPORTABLE PORTABLE TOY-ASSEMBLY SET

This is a continuation-in-part of parent application U.S. Ser. No. 08/019,891 filed Feb. 19, 1993, now abandoned.

PRIOR ART

Acknowledged prior art of mere interest includes: Bleeker U.S. Pat. No. 1175225 of March 1916, Petrie U.S. Pat. No. 1,247,145 of November 20, 1917, A. G. Holcombe et al. U.S. Pat. No. 255,171 issued March 21, 1882, Laird U.S. Pat. No. 2787863 April 1957, Djedda U.S. Pat. No. 3477723 of November 1969, Holbrook U.S. Pat. No. 4160427 of July 1979, Chan U.S. Pat. No. 4299050 of November 1981, O'Brian et al. U.S. Pat. No. 4822314 April 1989, Thompson U.S. Pat. No. 4856673 of August 1989, Spector U.S. Pat. No. 5071123 of December 1991, Miller U.S. Pat. No. 1449829 of March 1923, Sperling U.S. Pat. No. 3268107 of August 1966, Hepler U.S. Pat. No. 3359677 December 1967, Callin et al. U.S. Pat. No. 3400485 of September 1968, Tarrson U.S. Pat. No. 3434232 of March 1969, Sutton U.S. Pat. No. 4344534 of August 1982, Bertrand U.S. Pat. No. 5035324 of July 1991, Dentith British/United Kingdom patent 403804 of January 1934, Pavlov et al. USSR patent 291713 of May 1968, Kuster German patent 394037 Radiger et al. E. German patent 44346 of April 1924, Penillard et al. PCT/French patent 9014142 November 1990, Kyburz United Kingdom patent 2048088 December 1980, and U.S. Pat. Nos. 783,271 and 974,954 and 1,068,872 and 173,248 and 3807635.

While deemed to be not relevant to the present invention, of the foregoing patents, the Kyburz patent, the O'Brian et al patent, the laird patent, the Spector patent, the Thompson patent, the Kuster patent, the Holbrook patent,the Djedda patent, a reference referred to as Super Soaker™, and the Abel patent were patents cited and applied in the parent application. Of the foregoing, it is noteworthy that the Kyburz United Kingdom patent, utilized as a primary reference in the parent application prosecution, is not directed to a toy that is readily nor suitable for transporting by a child, nor does it have handles, nor all nor most pipes of short dimensions storable within the vessel, nor is such suggested by that patent, the structure of that patent being far from a "child's" toy—not meeting nor fulfilling the principal object stated hereinbelow for the present invention. To the contrary, the Kyburz patent is not suggestive of the present invention and is divergent therefrom, as non-analagous art as compared to the objects and claimed subject matter of the present invention. Also the Kyburz patent proposes the utilization of O-rings for use in connecting lengths of pipe together, and it is con, non knowledge that such type connections with O-rings become frequently "bound" to a degree that even a strong adult is unable to subsequently pull-apart the mated joints utilizing the O-rings, such patent teaching being a negative teaching insofar as any potential contemplated attempt for a child to have such as a part of a disassemable toy—making that patent even more non-analagous for any purported teaching of the present invention.

BACKGROUND TO THE INVENTION

Prior to the present invention, a child whether at home or on the beach or playground, is faced with a problem of the child's small size and minimal strength required for picking-up and transporting toys, particularly where such toy in its assembled state, is too large and cumbersome as contrasted to the age, size, height and minimal strength of the child. Also, a toy in the nature of a constructable toy, i.e. one that has multiple parts that may be assembled by the child, is equally important to the parent(s) that the disassemble parts or elements thereof, be easily and conveniently collectively both portable and transportable by the child in order to avoid loss of parts, as well as to train and educate the child in the practice of storing, putting-away and storing the separate parts thereof for reasons of each of tidiness and prevention of loss of one or more parts thereof.

From the standpoint of fun for the child, for a larger toy of particular one or more functions, normally a parent is required in order to both transport, assist and/or supervise use of such larger toy.

Characteristic of most children, the novelty of a toy quickly wears off, in the absence of the toy providing multiple possibilities for alternate sources of amusement.

In arriving at such a toy, seaside or beach use of a toy can be a definite advantage and asset and source of amusement to young/small children, particularly where playing with and/or handling water and/or sand are involved.

Children playing on a beach, at poolside or in other settings enjoy using water and directing its flow. Beach pails and sand shovels are well known utensils used in such play, as well as screens for sifting sand, and the like.

Many of the technologies for carrying water are theoretically adaptable to toys, but have not been accomplished. There are available various glued or otherwise rigidly-secured plastic plumbing elements such as unions, elbows, and tees.

Heretofore, there has been a significant absence of toys of maintainable and long-lasting interest to small children and/or maintainable and/or transportable by children, much less being of portable size, weight and shape.

Accordingly, there remains heretofore a need for a toy set that allows for and is conducive to a child to utilize the child's imagination and interest in ways of playing with a toy.

OBJECTS OF THE INVENTION

A primary object of the present invention is to provide a toy that is a composite assembly of a plurality of separate parts, cummulatively of size and shape enabling easy and ready portability thereof and resulting in being transportable easily and handily by a child of young age and/or size, with typically average mentality and dexterity.

Another object is to enable assembling by a child of young age and/or size and typically average mentality and dexterity, to with relative ease assemble and/or disassemble various parts or elements of a multi-assemblage of parts or elements Another object is to enable a child to assemble a toy assembly set by providing a reasonable but surmountable challenge to assemble in one or more different combinations to achieve different objectives as might be chosen or originated by the young and/or small child of typically average mentality and/or dexterity.

Other objects become apparent from the preceding and following disclosure.

SUMMARY OF THE INVENTION

In accord with and in light of the foregoing background and objects to this invention, broadly the invention is principally directed to a particular toy-assembly that is portable in nature, but of utmost and controlling importance and critical to this invention, that is of a size and nature that in a transportable state, is in fact transportable by a small and/or young child as regards height, strength, and such other limiting factors on the capabilities of a child. For purposes of the present invention, the objects are achieved by a child-transportable toy-assembly set that includes a plurality of parts and/or elements readily and easily assembled and readily disassembled and storable and transportable by a young and/or small child. That child-transportable portable toy-assembly set broadly consists essentially of:

a) a child-transportable portable water container toy structure and mechanism thereof;

b) an intermittently attachable and intermittently detachable water-flow toy structure and mechanism thereof; and c) a detachable toy support structure and mechanism thereof.

The child-transportable portable water container toy structure(s) and mechanism thereof provide for intermittently containing water. It additionally provides for draining water from a lower portion thereof. As well, the child-transportable portable water container structure(s) and mechanism(s) thereof:

(i) include a water-containable vessel having said lower portion, of a size (physical shape as well as light weight by virtue of toy-like smallness) readily and easily handled by a child, maneuverable by a child and transportable portably by a child;

(ii) defines water-containable space including water-containable space within the lower portion, where the space is adequate to produce a minor water-head pressure to assure adequate drainage flow, but concurrently sufficiently small as to be within the strength and safety capabilities of a child using such as a part of a children's toy composite set; and (iii) includes port structure forming an outlet port in flow communication with the lower portion adapted to at least one of (1) be attached to and (2) be attachable to and detachable from the lower portion by a child; as a result thereof (i.e., arising therefrom), water when contained within the water-containable space is drainable from the water-containable space to lower located exterior space substantially below the lower portion when the port structure is attached to the lower portion by a child in playful easy acts;

and additionally, the child-transportable portable water container toy means further includes water-input structure forming a water-addition opening from exterior space to and in communication with the water-containable space, of a predetermined size and predetermined shape and predetermined position condusive to and enabling addition of water thereto through the water-addition opening by acts of a child.

The small and/or light weight and short, i.e. storable nature of aforestated intermittently attachable and intermittently detachable water-flow toy structure(s)and mechanism(s) thereof provide for intermittent alternate attachment to and detachment from the port structure and outlet port thereof by a child. Additionally it concurrently provides for intermittently channeling water from the water-containable space through the outlet port when physically detachably handled and attached by the child to the port structure, to thereby channel water to lower-located exterior space after the port structure is attached by a child to the lower portion.

The aforestated detachable toy support structure(s) and mechanism(s) thereof provide for intermittent attachment to and detachment from the child-transportable portable water container toy means. Also the detachable toy support structure(s) and mechanism(s) additionally provide for maintaining the water container at a predetermined elevation sufficiently to produce a water-head above a supporting substrate. Arising/resulting from the two aforestated basic functions of the detachable toy support structure(s) and mechanism(s) thereof, there is/are established a predetermined water pressure by water when water is contained within at-least the lower portion of the water-containable space, of sufficient pressure to initiate and cause continued flow of water through the detachable water-flow means when the detachable water-flow means is connected in water-flow relationship to the flow structure enabling flow from the outlet port. The detachable toy support mechanism(s) and structure(s) thereof is/are of predetermined sufficiently small size and shape when in a detached state of disassembly, as to be storable and transportable together with the detachable water-flow means, within the water-containable space.

For the above-stated elements of the broad invention, the child-transportable portable water container toy structure and mechanism thereof is critically essential as an element of the invention by virtue of the essence of invention is the enabling of a child to have the capability to make playtime use of the portability aspect of the child-transportable portable water container structure(s) and mechanism(s) thereof as a result of the entire combination of being both portable "and" transportable as a result of short dimensions and light weight arising from these physical characteristics that result in combined beth portability and transportability for and by a child. Solely this invention provides for such combined physical characteristic resulting in both portability and transportability by thereby enabling utility thereof for a child, underscoring the criticality thereof.

In a first preferred embodiment as an improvement on the aforestated broad invention, the detachable support structure(s) and mechanism(s) thereof includes a plurality of removeable legs of sizes and shapes and configurations that a young and/or small child is able to transport, assemble onto the aforestated water container, and to store in the aforestated water container.

In a second preferred embodiment as an improvement on the first preferred embodiment, there is included an intermittently alternately attachable detachable toy handle structure(s) and mechanism(s) thereof for intermittently alternately attaching to and detaching from the child-transportable portable water container toy structure(s) and mechanism(s) thereof, at a position enabling a child to transport the child-transportable portable water container structure(s) and mechanism(s) thereof.

In a third preferred embodiment as an improvement on the second preferred embodiment, the intermittently attachable and intermittently detachable water-flow toy structure(s) and mechanism(s) thereof includes a) at-least one conduit-pipe having opposite open ends connected by through flow-space therethrough, and (b) at-least one tubular-fitting structure forming fitting flow space and having tapered opposite ends each forming a fitting opening in flow communication with the fitting flow space, the at-least one tubular fitting structure alternately being intermittently attachable by a child to and between each of (i) the port structure and the outlet port thereof and (ii) one of the tapered opposite ends, and being intermittently detachable by a child from a) the port structure and the outlet port thereof and b) one of the tapered opposite ends.

In a fourth preferred embodiment as an improvement on the third preferred embodiment, there is included an intermittently attachable and intermittently detachable toy valve structure(s) and mechanism(s) thereof for detachably alternate mounting and dismounting by a childbetween the at-least one tubular fitting structure and at-least one of (a) another of the tubular fitting structure and (b) the port structure and the outlet port thereof, the intermittently attachable and intermittently detachable valve structure(s) and mechanism(s) thereof being of a predetermined size and shape for alternately increasing and decreasing potential water flow when attached, and for storage by a child within the water-containable space when detached by a child.

In a fifth preferred embodiment as an improvement on the fourth preferred embodiment, the toy handle structure(s) and mechanism(s) thereof includes a vessel-top structure of a predetermined shape adapted to be fit by a child over the water-addition opening of the water-input structure and intermittently be attached by a child onto the water-input structure.

In a sixth preferred embodiment as an improvement on the fifth preferred embodiment, the vessel-top structure is shaped to form top-enclosure space such that when inverted is containable of small child-transportable matter, and the intermittently alternately attachable and detachable toy handle structure(s) and mechanism(s) thereof further including a handle structure of a size shape and position enabling grasping and lifting by a child, mounted on the vessel-top structure.

In a seventh preferred embodiment, as an improvement on the sixth preferred embodiment, there is included a toy water-impelled accessory connectable by a child to at-least one of a) the port structure and outlet port thereof, b) the intermittently attachable and intermittently detachable water-flow toy structure(s) and mechanism(s) thereof, and c) the intermittently attachable and intermittently detachable toy valve structure(s) and mechanism(s) thereof.

In an eighth preferred embodiment, as an improvement on the broad invention, there is the same improvement as the second preferred embodiment.

In a ninth preferred embodiment, as an improvement on the broad invention, there is the same improvement as the third preferred embodiment.

In a tenth preferred embodiment, as an improvement on the broad invention, there is the same improvement as the fourth preferred embodiment.

In an eleventh preferred embodiment, as an improvement on the broad invention, there is the same improvement as the fifth preferred embodiment.

In a twelfth preferred embodiment, as an improvement on the broad invention, there is the same improvement as the sixth preferred embodiment.

In a thirteenth preferred embodiment, as an improvement on the broad invention, there is the same improvement as the seventh preferred embodiment.

In a fourteenth preferred embodiment, as an improvement on the broad invention, at-least one of the an intermittently attachable and intermittently detachable water-flow toy structure(s) and mechanism(s) thereof is substantially transparent.

In a fifteenth preferred embodiment, as an improvement on the broad invention, at-least two the plurality of removeable legs are mounted in series with each other.

In a sixteenth preferred embodiment, a toy set for use at a beach or elsewhere, comprises/includes at least:

a) a water container having port structure forming an outlet port;

b) a plurality of interconnectable pipes sized for storage inside said container, at least one of said pipes being connectable to said outlet port of said container;

c) a water accessory connectable to at least one of said pipes for using water stored in said container, said accessory comprising a sand settling tank having an accessory water inlet and an accessory water outlet sized to connect with at least one of said pipes, the sand settling tank comprising a plurality of spaced, horizontal sand screens gradable by size sand flowing into said tank.

In a seventeenth preferred embodiment, a toy set for use at a beach or elsewhere, comprises/includes at least:

a water container having an outlet port, a bottom and a plurality of removeable elevating legs at the bottom, the legs being sized for storage in the container;

a plurality of interconnectable pipes sized for storage inside the container, at least one of the pipes being connectable to the outlet port of the container; and a water accessory connectable to one of the pipes for using water stored in the container, in which the settling tank comprises a plurality of spaced, horizontal sand screens for grading by size sand flowing into the tank.

The invention may be better understood by making reference to the following drawing.

THE FIGURES

FIG. 6 is an illustration of another water accessory, namely, a water gun;

FIG. 7 is a schematic illustration of another water accessory employing a water driven shaft to move certain parts;

FIG. 8 is perspective view of a valve that is an alternate to that illustrated in FIG. 1;

FIG. 9 is side view of optional action figures that can be made to pass through the pipes of FIG. 1, especially when the pipes are transparent.

DETAILED DESCRIPTION

Figure 1:
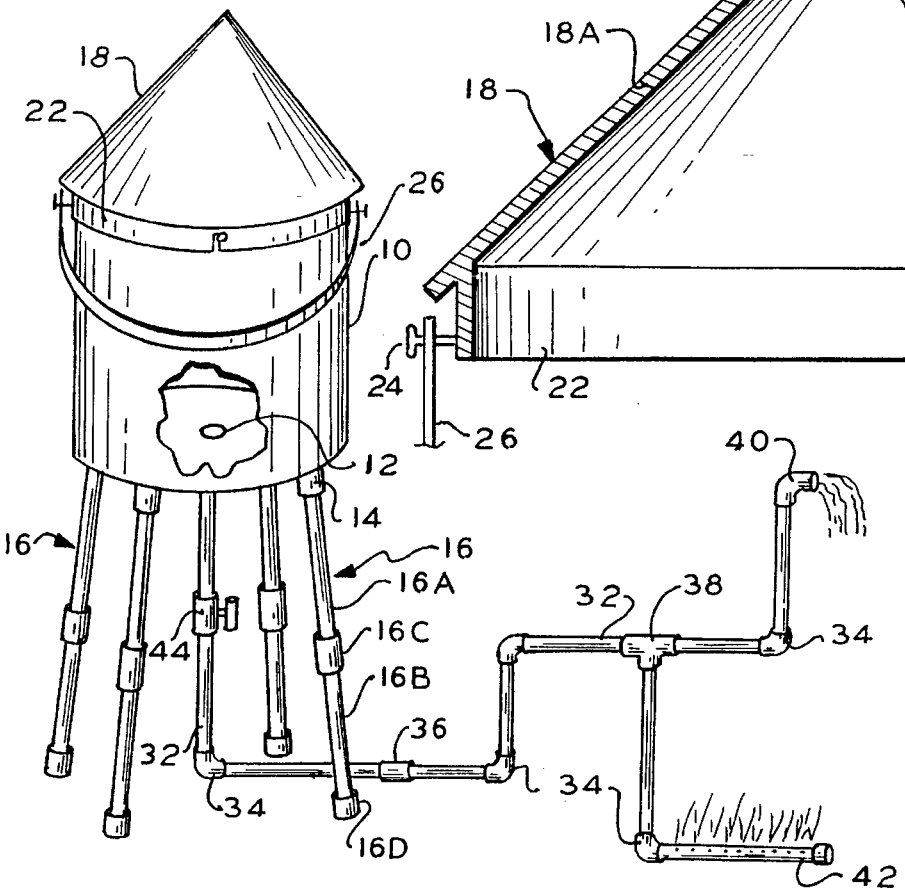
FIG. 1 is an perspective view of an assembled toy set in accordance with the principles of the present invention.

In accordance with the illustrative embodiments demonstrating features and advantages of the present invention, there is provided a toy set for use at a beach or elsewhere. The toy set includes a water container having an outlet port. The set includes a plurality of interconnectable pipes sized for storage inside the container. At least one of the pipes can be connected to the water outlet of the container. Also included is a water accessory that can be connected to one of the pipes for using water stored in the container.

By employing such apparatus, an improved toy set is achieved. In a preferred embodiment, a plastic container supported on four removable legs has a floor drain. The preferred set includes a number of pipes and fittings that can be interconnected to form a water passage system as simple or complex as the child's imagination dictates.

These pipes can terminate in various accessories. Also, the pipes can employ a serial shut off valve to control the water flow. The removable legs, the fittings, the valves, the pipes and the accessories can all be disassembled and stored inside the water container.

In one preferred embodiment, the water container has a lid with a concave underside that doubles as a bucket for carrying water to fill the container. Preferably, the lid can lock or snap onto the water container and can employ a carrying handle, Thus the toy set can be transported by storing its separate components inside the water container, locking the lid thereon and carrying the package by the handle.

Various accessories can be used with the toy set, such as a water sprinkler or water spout. Also, some sets may include a turbine or water wheel that rotates a drive shaft. The drive shaft can animate a figure, or can drive a gear train that the child can assemble onto a peg board structure.

Still another possible accessory is a sand settling tank. The water mixed with sand in the storage tank can form a slurry with the sand and pass through a cylindrical settling chamber. The chamber can have a series of horizontal screens for grading by size, sand flowing through the settling chamber. Thus a unique visual effect is created. After the sand has filled the settling tank, it can be inverted to allow the sand to shift to another position.

The visual impact of the set can be enhanced by making the pipes and other components transparent so that the sand slurry or foam caused by the slurry is visible.

Additionally, the toy set can be used with just the pipes and fittings alone. In this case the child can dig holes in the sand and fill them with water to act as reservoirs. These reservoirs can be drained or connected to other reservoirs by means of the pipes and fittings. Also, the water flowing from a reservoir can supply one of the aforementioned accessories.

Referring to FIGS. 1–4, a toy set is illustrated with a water container 10 having a generally cylindrical shape and on its floor a concentric water outlet 12. The lower end of outlet 12 is formed into a collar. In some embodiments a stopper or flap can be employed on outlet 12 especially in embodiments where the container 10 is used to carry water. In this embodiment, container 10 can be a three to four gallon container, although other sizes are contemplated. As shown herein, the container is about 12 inches high and 10 inches in diameter, although a different dimensional ratio can be used in other embodiments.

Container 10 has four leg receptacles 14 (only two visible) for holding four removable legs 16. In other embodiments, a different number of legs may be employed. Legs 16 are shown each having an upper pipe segment 16A and a lower pipe segment 16B interconnected by a tubular union 16C. The lower end of leg 16B has a cap 16D. The leg segment pairs 16A and 16B may have different lengths. Accordingly, by selecting one or both of the segments of the pair, container 10 typically can be set at one of two heights. In one embodiment leg 16 is typically about 24 inches long overall, with the two segments 16A and 16B typically each about fourteen and ten inches long, respectively.

While container 10 is illustrated as a cylinder, in some embodiments it may be spherical, cubical, a rectangular solid, an oval, pear-shaped, etc. Also in some embodiments the container 10 may be shaped to represent a cartoon character or some other three dimensional object. Container 10 is preferably molded from plastic, but may instead be made from sheet metal, ceramics or other materials. Also in some embodiments, the container may feature integrally molded legs or no legs at all. Especially in embodiments lacking legs, the container can have a raised floor and a lower water outlet near the bottom of container 10.

Lid 18 is illustrated as a conical cover having a lower annular wall 22. Annular cover 22 is shown with a small eves, although eaves may not be employed in all embodiments. In other embodiments, the concave underside of lid 18 may have a cylindrical, hemispherical, cubical, rectangular, oval, or other shape. Preferably however, the underside of lid 18 is shaped to serve as a bucket. Also, lid 18 may have a fanciful shape representing the head of a cartoon character or other object. Container 10 may also be painted or bear decal(s) or other decorations to enhance its aesthetic appearance.

Molded on diametrically opposite sides of annular wall 22 are a pair of studs 24 for pivotally supporting a band 26, which acts as a carrying handle. The ends of studs 24 can be heat peened to permanently affix handle 26 to lid 18. Handle 26 can be pivotally attached to other regions of lid 18. Also in some embodiments, the handle may be eliminated or may be a grip rigidly molded to lid 18.

Figure 3:
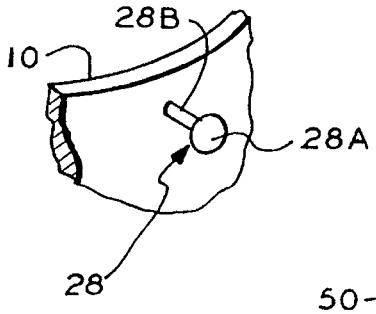
FIG. 3 is an perspective view of a knob projecting from a fragment of the water container of FIG. 1.

Molded on diametrically opposite sides of container 10 near its upper rim are a pair of knobs 28 illustrated in FIG. 3 having a cylindrical stem 28B supporting spherical head 28A. Stem 28B is designed to fit in a curved slot 30 in annular wall 22. Slot 30 is shown having an inverted J-shape, although other shapes are possible. Also alternate locking means are contemplated such buckles, straps, tongue and groove (or tongue and ridge) snap lids, threaded lids and containers, etc. In some embodiments, no lid will be employed at all and the container 10 can be carried to the water, filled and carried to the play site. In such embodiments lacking a lid, a carrying handle may be attached directly to the container.

Interconnectable pipes 32 are shown herein as segments of various lengths, suitably 3 to 18 inches long, although in some embodiments, these different lengths may be chosen depending upon the desired play characteristics. Pipes 32 are transparent so the child can enjoy watching water and possibly sand flowing from container 10 through the pipes. In some embodiments, pipes 32 may be curved or flexible. Various pipes shapes including helical pipe sections are contemplated.

Pipe segments 32 can be directly interconnectable or indirectly interconnectable. In this embodiment, pipes 32 are indirectly interconnectable by means of the illustrated fittings. The fittings includes such elements as an elbow 34, a union 36, and a T-connector 38. The pipes 32 are shown interconnected in a pattern selected by the child. In this embodiment, the child uses a T-connector 38 so that the water splits there into two branches. One branch terminates in a water spout 40. Spout 40 is shown as a right angled bend and may have a nozzle, spray head, or other features to create an interesting water pattern flowing from the spout. Another branch from T-connector 38 terminates in a sprinkler 42, shown as a length of pipe having a plurality of holes from which water streams. Sprinkler 42 can be of any desired shape and various sprinkler patterns used for lawn sprinklers and other purposes may be incorporated herein. Spout 40 and sprinkler 42 and other like water accessories are herein referred to as water accessory means.

A valve 44 is shown serially connected between pipes communicating with outlet 12. Valve 44 can be one of various types of regulating or shut off valves. For example, valve 44 can include a ball with a diametric bore that is either rotated into alignment with pipes 32 to allow flow or to a transverse position to shut off the flow. Preferably, valve 44 should be constructed to operate in the presence of a slurry such as water and sand without binding. In some simplified embodiments, valve 44 can simply be a flexible hose which is pinched by an external clamp to stop water flow.

Figure 4:
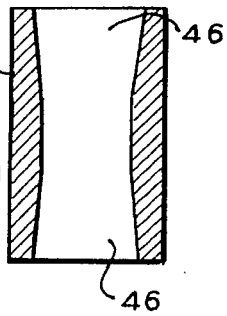
FIG. 4 is an axial sectional view of one of the fittings of FIG. 1.

FIG. 4 shows an axial sectional view of union 36 to illustrate a tapered receptacle 46 at either end of union 36. The other fittings will have a similar tapered receptacle. Because the receptacles are thus tapered, the pipes and fittings can be interconnected by simply thrusting them together axially. The child need not manipulate threads or other complicated seals or fasteners to assemble the pipes. Also, tapered receptacles reduce the risk of binding from sand or foreign material.

While a limited number of fittings are illustrated it will be appreciated that other fitting types, including Y connectors, and four way connectors, may be employed also. Also in some embodiments, a switching valve may be used to select one of several outlet paths for the water flow. Other common plumbing fixtures may be employed as well, such as check valves, float operated valves, traps, vents, etc.

Figure 5:
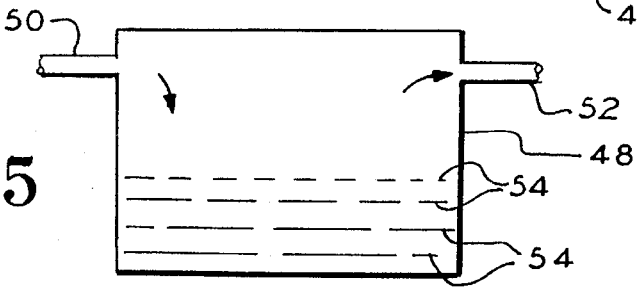
FIG. 5 is a schematic illustration of a water accessory, shown herein as a settling tank.

Referring to FIG. 5, a water accessory is illustrated as a sand settling tank 48. Tank 48 may be a cylindrical chamber having an inlet 50 and outlet 52. A slurry of water and sand can flow into tank 48 with sand descending and water exiting through outlet 52. Also, spaced sand screens 54 are horizontally mounted in the lower portions of tank 48. The upper screens 54 may be the courser while the lower screens 54 may be finer. Accordingly, the sand in a slurry passing through settling tank 48 will settle and be separated by grade into different layers. When the child has seen enough sand settle into tank 48 it may be inverted and shaken to return the sand through screens 54 to be either flushed through outlet 52 or resettled through the screens if tank 48 is to be righted.

Still another water accessory is illustrated in FIG. 6. A water gun 56 receives a water supply from a pipe (or hose 32). Pipe 32 communicates with a nozzle 58 at the muzzle of gun 56. Gun 56 employs a compressed air chamber 60 that can be filled with compressed air by manually pumping a lever or plunger 62. The compressed air of chamber 60 is mixed with water from pipe 32 to produce an energetic water jet 64. It will be appreciated that various types of water guns can be employed and a simple mechanical pump, such as in a toy water pistol can be used as well.

Referring to FIG. 7, still another water accessory is illustrated. Herein a water wheel or turbine acts as a drive means 66, supplied by inlet 68 and drained by outlet 70. Water flowing through drive means 66 will rotate drive shaft 72. In this embodiment, a crank arm 74 reciprocates connecting rod 76. Rod 76 is attached to the back of a movable FIG. 78 shown mounted in a slot 80 to reciprocate horizontally. It will be appreciated that FIG. 78, shown as a star, can be any one of a number of figures or can be an animated arm which is part of a larger figure, etc.

The torque of shaft 72 is also used to rotate removable gears 82. Gears 82 are detachably mounted on pegs in panel 84. The pegs can be removable as well and the position of the gears can be changed imaginatively. While drive means 66 continuously turns a shaft, in other embodiments, an oscillating motion can be produced by the drive means directly.

Referring to FIG. 8, a valve is shown which is an alternate to that of FIG. 1. The valve of FIG. 8 has a T-shaped housing 86 having a cylindrical passageway 86A that is open at both ends. A passageway 86B is perpendicular to passageway 86A. Inserted into one end of passageway 86A is a cylindrical plug 88 shown as a hollow cylinder, closed on the end that has a adjustment flange 90. Plug 88 has a transverse hole 92. The plug 88 is inserted into one end of passageway 86A so the hole 92 can be rotated either into alignment with or away from passageway 86B. An advantage with valve construction of this type is its relative simplicity and the fact that the child can disassemble the valve to study its operation. Also, the valve is reliable enough to handle a sand slurry without binding or excessive wear.

Referring to FIG. 9, previously illustrated pipe 32 is shown transparent so that FIGS. 94 moving inside pipe 32 are visible. FIGS. 94 are designed to amuse the child and are shown as an arrow, a flying person and a truck. Obviously, various other action figures can be used provided they are small enough to flow within the pipes as well as their fittings and valves. In some embodiments, the figures will be cut from flat stock and be therefore two dimensional. Alternatively, the figures can be three dimensional and molded from plastic or other appropriate materials. The figures can be made hollow to give them a certain degree of positive buoyancy or neutral buoyancy. In still other embodiments, the chosen materials will be heavier than water so that the action FIGS. 94 tend to sink. As an example, the action figures designed to pass through a tube having a 1¼ inch diameter would have a radial dimension of about ¾ inch and a length of twice that radial dimension, although different dimensions and proportions are contemplated.

Figure 2:
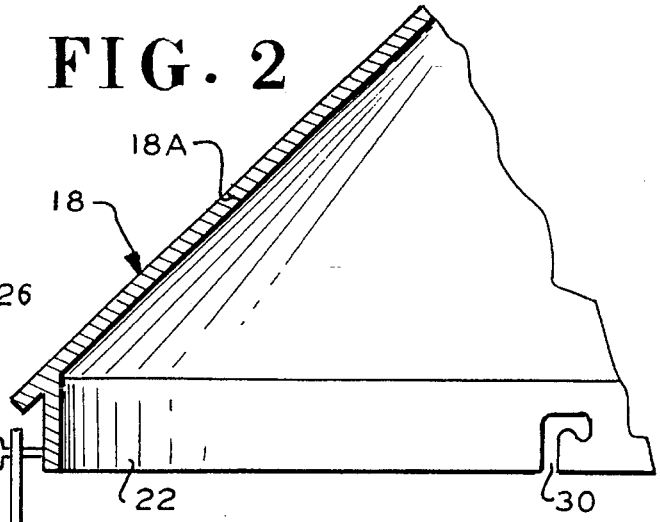
FIG. 2 is a vertical sectional view through a fragment of the lid of the toy set of FIG. 1.

To facilitate an understanding of the principles associated with the foregoing apparatus, its operation will be briefly described. The set can be carried by handle 26 to a beach, lake, pool, garden, lawn or other play area with all of the various illustrated parts stored inside container 10 and with lid 18 locked on top. At the play site, lid 18 can be twisted to free slot 30 from knob 28 (FIGS. 2 and 3). Then lid 18 can be removed and the various components stored therein removed as well.

Removable legs 16 may be initially installed into leg receptacles 14. Thereafter, a pipe can be inserted into the collar of outlet 12. In the illustrated embodiment, valve 44 is thereafter immediately serially connected to the pipe connected to outlet 12, although this need not be the case.

Using the various fittings 34–38 as well as the pipes 32 of various lengths, a system of pipes can be built. In some embodiments, more than one container may be employed and a tee fitting can be used to connect them in parallel or otherwise, to provide a more complicated system. Also pipes may be separated from the container to provide a conduit system for transferring water between basins dug in the sand by the child.

The action begins by carrying water with or without sand in the inverted Lid 18 and pouring the same into container 10. Valve 44 may then be manipulated to begin water or a sand slurry flowing through the pipes and fittings. The various accessories described herein can be connected into the system to enhance the enjoyment of the play. With transparent pipes, the enjoyment is further enhanced by placing the action FIGS. 94 (FIG. 9) in container 10 to flow through pipes 32. The FIGS. 94 can spill out of a spout or other appropriate accessory into a pail or elsewhere.

When the child is finished, the various pipes, fittings, accessories and legs can be disassembled, rinsed and stored inside container 10. Then, lid 18 can be fitted atop container 10 and twisted in place so that knobs 28 engage slots 30 in annular wall 22 to lock the lid and container together. As before, the set can be carried by means of handle 26.

It is to be appreciated that various modifications may be implemented with respect to the above described embodiments. The toy set can have all or only some of the accessories, fittings and pipes herein. For example, a sample set may be sold for younger child without having many complicated components. Also, the size and length of the various components can be altered depending upon the intended volume, capacity, and flow rate of the toy. Also besides the pipes, other components in a set can be made transparent or can be tinted with various colors. Moreover, the container can have multiple outlets to add to the complexity of the possible designs. Furthermore, valves can be built into the outlets of the container so that a separate valve assembly is not needed. Also the various components can be formed of various types of plastic, metal, ceramic and other materials depending upon the desired strength, durability, etc. Also, while force fittings are preferred between the pipes and fittings, in other embodiments threads, bayonet couplings may be used as well as other features such as gaskets. In some embodiments, the pipes may have a narrow and a wide end so that pipes can be connected together directly, end to end, without the need for separate fittings. The set can also be enhanced by including other conventional beach toys such as sand shovels, sand screens and other items which are sized to fit inside the container 10.

Obviously, many modifications and variations of the present invention are possible in light of the above teachings. It is therefore to be understood that within the scope of the appended claims, the invention may be practiced otherwise then as specifically described.

I claim:

1. A child-transportable portable toy-assembly set consisting essentially of:

a) a child-transportable portable water container toy means for intermittently containing water and for draining water from a lower portion thereof, the child-transportable portable water container means (i) including a water-containable vessel having an inner linear dimension and said lower portion, transportable portably by a child, (ii) defining hollow water-containable space within said lower portion of a sufficiently large volume adequate to produce a predetermined minor water-head pressure sufficient to assure adequate drainage flow, and concurrently sufficiently of a predetermined smallness as to be within the strength and safety capabilities of a child using such water container toy means as a part of a children's toy composite set; and (iii) a downwardly-directed aperture for drainage on a bottom-most portion of said water-containable vessel; and said child-transportable portable water container toy means further comprises an open top-forming structure;

b) a detachably mountable water-flow toy means for intermittent alternate attachment to and detachment from said bottom-most portion of said water-containable vessel at said downwardly directed aperture for channeling water from said water-containable space through said downwardly directed aperture to an exterior space located beneath said water containable vessel; and c) detachably mounted support legs ranging in length up to said linear dimension mounted on and supporting said water-containable vessel, and downwardly-directed support-structure means on said lower portion for detachably mounting said detachably mounted support legs on said water containable vessel and for maintaining said water-containable vessel container at a predetermined elevation sufficient to provide space for the detachably mountable water-flow toy means; and d) all water-flow toy means and support legs being sized to be contained within said water-containable vessel for ease of transport by a child.

2. The child-transportable portable toy-vessel set of claim 1, including an intermittently alternately attachable and detachable toy handle means for intermittently alternately attaching to and detaching from said child transportable portable water-container toy means, at a position enabling a child to transport the child-transportable portable water-container means.

3. The child-transportable toy-assembly set of claim 2, in which said detachably mountable water-flow toy means includes (a) at-least one conduit-pipe having opposite open ends connected by through flow-space therethrough, and (b) at-least one tubular-fitting structure forming fitting flow space and having tapered opposite ends each forming a fitting opening in flow communication with the fitting flow space, the at-least one tubular fitting structure alternately being intermittently attachable by a child to and between each of (i) said bottom-most portion and said downwardly-directed aperture and (ii) one of said tapered opposite ends, and being intermittently detachable by a child from a) said bottom-most portion and said downwardly-directed aperture and (b) said one of said tapered opposite ends.

4. Child-transportable portable toy-assembly set of claim 3, including an intermittently attachable and intermittently detachable toy valve means for detachably alternate mounting and dismounting by a child between said at-least one tubular-fitting structure and at-least one of (a) another of said tubular fitting structure and (b) said bottom-most portion and said downwardly-directed aperture, said intermittently attachable and intermittently detachable toy valve means being of a predetermined size and shape for alternately increasing and decreasing potential water flow when attached, and for storage by a child within said water-containable space when detached by a child.

5. The child-transportable portable toy-assembly set of claim 4, in which said open top-forming structure forms an upper opening in said water-containable vessel continuous with said hollow water-containable space, and in which said intermittently alternately attachable detachable toy handle means includes a vessel-top structure of a predetermined shape adapted to be fit by a child over said upper opening of said open top-forming structure and to be intermittently attached by a child onto said olden top-forming structure.

6. The child-transportable portable toy-assembly set of claim 5, in which said vessel-top structure is shaped to form top-enclosure space such that when inverted is containable of small child-transportable matter, and said intermittently alternately attachable and detachable toy handle means further including a handle structure of a size, shape and position enabling grasping and lifting by a child, mounted on said vessel-top structure.

7. The child-transportable portable toy-assembly set of claim 6, including a toy water-impelled accessory connectable by a child to at-least one of a) said intermittently attachable and intermittently detachable water-flow toy means, and b) said detachably mounted water-flow toy means, and c) said intermittently attachable and intermittently detachable toy valve means.

* * * * *